United States Patent [19]

Ohmori et al.

[11] Patent Number: 5,008,706

[45] Date of Patent: Apr. 16, 1991

[54] ELECTROPHOTOGRAPHIC APPARATUS

[75] Inventors: Hiroyuki Ohmori, Tokyo; Hisami Tanaka, Yokohama; Masami Okunuki, Tokyo, all of Japan

[73] Assignee: Canon Kabushiki Kaisha, Tokyo, Japan

[21] Appl. No.: 426,197

[22] Filed: Oct. 25, 1989

[30] Foreign Application Priority Data

Oct. 31, 1988 [JP] Japan ..... 63-276879
Nov. 24, 1988 [JP] Japan ..... 63-297511

[51] Int. Cl.[5] ..... G03G 21/00; G03G 15/02

[52] U.S. Cl. ..... 355/219; 355/222; 361/225

[58] Field of Search ..... 355/219, 221, 222, 227; 361/221, 225, 230; 430/35, 56, 58; 118/644, 661

[56] References Cited

U.S. PATENT DOCUMENTS

| | | | |
|---|---|---|---|
| 4,309,803 | 1/1982 | Blaszak | 355/219 X |
| 4,380,384 | 4/1983 | Ueno et al. | 355/219 |
| 4,387,980 | 6/1983 | Ueno et al. | 355/219 |
| 4,455,078 | 6/1984 | Mukai et al. | 355/219 |
| 4,663,259 | 5/1987 | Fujimura et al. . | |
| 4,727,453 | 2/1988 | Ewing | 355/219 X |
| 4,835,079 | 5/1989 | Fujimura et al. . | |
| 4,855,202 | 8/1989 | Yoshihara et al. | 430/56 X |
| 4,877,701 | 10/1989 | Hiro et al. . | |
| 4,910,536 | 3/1990 | Fujimura et al. . | |
| 4,922,299 | 5/1990 | Uchimoto et al. | 355/219 |

FOREIGN PATENT DOCUMENTS

| | | | |
|---|---|---|---|
| 0104350 | 8/1981 | Japan | 355/219 |
| 0104351 | 8/1981 | Japan | 355/219 |
| 56-104351 | 8/1981 | Japan . | |
| 0104352 | 8/1981 | Japan | 355/219 |
| 57-178267 | 11/1982 | Japan . | |
| 58-40566 | 3/1983 | Japan . | |
| 58-139156 | 8/1983 | Japan . | |
| 58-150975 | 9/1983 | Japan . | |
| 1-261675 | 10/1989 | Japan | 355/219 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An electrophotographic apparatus including a photosensitive member and a charging member disposed in contact with the photosensitive member; the photosensitive member being capable of being charged by applying a voltage to the charging member; wherein the ten-point mean surface roughness ($Rz_1$) of the photosensitive member and the ten-point means surface roughness ($Rz_2$) of the charging member satisfy the following relationships:

$0.1 \text{ micron} \leqq Rz_1 + Rz_2 \leqq 6.0 \text{ microns}$,
$0.05 \text{ micron} \leqq Rz_1 \leqq 5.0 \text{ microns}$, and
$0.05 \text{ micron} \leqq Rz_2 \leqq 5.0 \text{ microns}$.

11 Claims, 3 Drawing Sheets

ELECTROPHOTOGRAPHIC APPARATUS

FIELD OF THE INVENTION AND RELATED ART

The present invention relates to an electrophotographic apparatus, more particularly to an electrophotographic apparatus including a charging means which is capable of directly charging an electrophotographic photosensitive member.

In conventional electrophotographic processes, there have been used photosensitive members utilizing a photosensitive layer comprising selenium, cadmium sulfide, zinc oxide, amorphous silicon, organic photoconductor, etc. These photosensitive members are generally subjected to a fundamental electrophotographic process including charging, exposure, developing, transfer, fixing and cleaning steps, whereby a copied image is provided.

In the above-mentioned conventional charging step, in most cases, a high voltage (DC voltage of about 5–8 KV) is applied to a metal wire to generate a corona, which is used for the charging of the photosensitive member. In this method, however, a considerable amount of corona discharge product such as ozone and NOx is generated along with the generation of corona. Such a corona discharge product deteriorates the photosensitive member surface to cause image quality deterioration such as image blur (or image fading). Further, because the contamination on the metal wire affects the image quality, there occurs a problem that white droppings (or white dropouts) or black streaks appear in the resultant copied image.

Particularly, an electrophotographic photosensitive member having a photosensitive layer mainly comprising an organic photoconductor (hereinafter, referred to as "OPC photosensitive member") has a lower chemical stability than that of another amorphous silicon-type or selenium-type photosensitive member, and is liable to cause a chemical reaction (mainly, an oxidation reaction) to be deteriorated when subjected to the corona discharge product. Therefore, when such a photosensitive member is repeatedly used under the action of corona discharge, there occur image blur due to the above-mentioned deterioration and decrease in copied image density due to sensitivity decrease in the photosensitive member. As a result, the life of the OPC photosensitive member is liable to be shortened in successive copying operation.

Further, in the above-mentioned corona charging method, the proportion of the current directed to the photosensitive member is generally 5–30% of the consumed current, and most thereof flows to a shield plate disposed around the metal wire. As a result, the conventional corona charging method has been low in electric power efficiency.

Therefore, in order to solve the above-mentioned problems, there has been researched a contact charging method wherein a charging member is caused to directly contact a photosensitive member to charge the photosensitive member without using a corona discharger, as disclosed in Japanese Laid-Open Patent Application (JP-A, KOKAI) Nos. 178267/1982, 104351/1981, 40566/1983, 139156/1983, 150975/1983, etc. More specifically, in this method, a charging member such as electroconductive elastic roller to which a DC voltage of about 1–2 KV is externally applied is caused to contact the surface of a photosensitive member thereby to charge the photosensitive member surface up to a predetermined potential.

However, in spite of the above-mentioned many proposals, an electrophotographic apparatus utilizing the direct (or contact) charging method has never been put on the market up to the present. The reason for this is, e.g., that the conventional direct charging method cannot charge a photosensitive member uniformly but causes a dielectric breakdown of the photosensitive member due to the direct application of a voltage.

Thus, when charging treatment is conducted by the conventional contact charging method, a photosensitive member surface is not evenly charged to cause charging unevenness (or charging irregularity) in the form of spots. Accordingly, e.g., in the normal development system, when the photosensitive member having the charging unevenness in the form of spots is subjected to an electrophotographic process, the output image includes white spot-like images (white spots), i.e., there occurs a phenomenon such that white spots appear in the resultant solid black image. On the other hand, the reversal development system only provides an image including an image defect such as fog.

In order to solve the above-mentioned problems and to enhance the charging evenness, there has been proposed that an AC voltage ($V_{AC}$) is superposed on a DC voltage ($V_{DC}$) to be supplied to a charging member (Japanese Laid-Open Patent Application No. 149668/1988). In this method, the resultant pulsation voltage is applied to the charging member, thereby to effect uniform charging.

In such a case, in order to retain the uniformity in charging and to prevent an image defect such as the white spot in the normal development system, and the fog or black spot in the reversal development system, it is necessary that the AC voltage to be superposed has a peak-to-peak potential difference (Vpp) which is at least two times that of the DC voltage. However, when the AC voltage to be superposed is increased in order to prevent the image defect, discharge dielectric breakdown is liable to occur in a portion of the interior of the photosensitive member having a slight defect, due to the maximum (or peak) application voltage of the pulsation voltage. Particularly, an OPC photosensitive member having a low dielectric strength causes more remarkable dielectric breakdown.

When the above-mentioned dielectric breakdown occurs, the normal development system provides a white defect or white dropout extending along the longitudinal direction of the contact portion between the charging member and the photosensitive member. On the other hand, the reversal development system provides a black streak extending along the longitudinal direction of the contact portion. Further, when the photosensitive member has a pin hole, such a portion becomes a conducting path and causes leakage of a current, whereby the voltage applied to the charging member drops.

SUMMARY OF THE INVENTION

An object of the present invention is to provide an electrophotographic apparatus which does not cause a white spot or fog due to charging unevenness, or an image defect due to a current leak in the photosensitive member, is capable of providing a long life of the photosensitive member in repetitive copying operations, and is capable of stably providing high-quality copied images.

Another object of the present invention is to provide an electrophotographic apparatus which is capable of preventing the dielectric breakdown of the photosensitive member and is capable of repeatedly providing high-quality images as a whole, even when an AC voltage ($V_{AC}$) is superposed on a DC voltage to effect voltage application.

According to the present invention, there is provided an electrophotographic apparatus comprising a photosensitive member and a charging member disposed in contact with the photosensitive member; the photosensitive member being capable of being charged by applying a voltage to the charging member; wherein the ten-point mean surface roughness ($Rz_1$) of the photosensitive member and the ten-point mean surface roughness ($Rz_2$) of the charging member satisfy the following relationships:

$$0.1 \text{ micron} \leqq Rz_1 + Rz_2 \leqq 6.0 \text{ microns},$$
$$0.05 \text{ micron} \leqq Rz_1 \leqq 5.0 \text{ microns, and}$$
$$0.05 \text{ micron} \leqq Rz_2 \leqq 5.0 \text{ microns.}$$

According to out investigation, it has been considered that, in the direct charging method wherein a charging member is caused to contact an electrophotographic photosensitive member to charge the photosensitive member, the charging is effected on the basis of discharge in a minute space provided in the vicinity of the contact portion between the photosensitive member and the charging member. Since the discharge phenomenon between a pair of opposite electrodes can considerably be affected by the shape or form of the electrode, it has been considered that the charging evenness in the direct charging method can considerably be changed by the surface roughness of the photosensitive member and/or charging member.

We have conducted various experiments while changing the surface unevennesses of the photosensitive member and charging member, respectively, whereby we have found a specific correlation between these roughnesses and the resultant charging evenness.

More specifically, according to our investigation, when the sum of the ten-point mean surface roughness ($Rz_1$) of the photosensitive member and the ten-point mean surface roughness ($Rz_2$) of the charging member is made 0.1 micron or larger and 6.0 micron or smaller while regulating the $Rz_1$ and $Rz_2$ so that they satisfy relationships of 0.05 micron$\leqq Rz_1 \leqq$5 microns, and 0.05 micron$\leqq Rz_2 \leqq$5 microns, respectively, uniform charging has been effected while attaining a good potential characteristic. It is considered that the above-mentioned specific surface roughnesses provide suitably roughened surface portions, which are usable as starting points for discharge, to both of the photosensitive member and charging member, whereby the firing voltage (or discharge-initiating voltage) is lowered and the charging ability of the charging member is enhanced.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In the electrophotographic apparatus according to the present invention, the sum of the ten-point mean surface roughness ($Rz_1$) of a photosensitive member and the ten-point surface roughness ($Rz_2$) of a charging member is not smaller than 0.1 micron and not larger than 6.0 microns, and the $Rz_1$ and $Rz_2$ satisfy the relationships of 0.05 micron$\leqq Rz_1 \leqq$5 microns, and 0.05 micron$\leqq Rz_2 \leqq$5 microns, respectively.

When the sum of $Rz_1$ and $Rz_2$ is smaller than 0.1 micron, the surfaces of the photosensitive member and charging member become substantially smooth, and the firing voltage becomes higher. As a result, it is necessary to raise the voltage applied to the charging member, in order to retain charging stability. Further, when the application voltage is excessively raised, the photosensitive member may cause dielectric break down.

On the other hand, when the sum of $Rz_1$ and $Rz_2$ exceeds 6 microns, the convexities and concavities become too great and charging irregularity occurs, whereby charging evenness cannot be retained.

In the present invention, the above-mentioned sum of $Rz_1$ and $Rz_2$ may preferably be not smaller than 1.3 micron and not larger than 5.3 microns, more preferably not smaller than 2.0 microns and not larger than 4 microns.

The $Rz_1$ of the photosensitive member is not smaller than 0.05 micron and not larger than 5 microns, but may preferably be not smaller than 0.1 micron and not larger than 3 microns, more preferably not smaller than 0.3 micron and not larger than 2 microns. The $Rz_2$ of the charging member is not smaller than 0.05 micron and not larger than 5 microns, but may preferably be not smaller than 0.1 micron and not larger than 4 microns, more preferably not smaller than 0.3 micron and not larger than 3 microns.

Figure 1:
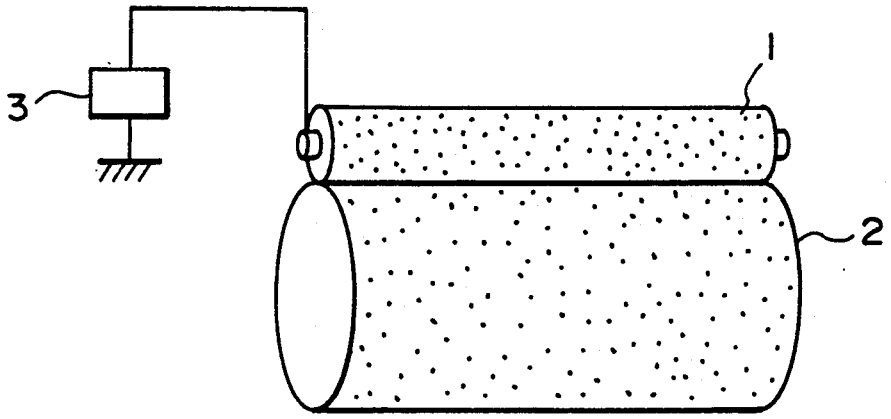
FIG. 1 is a schematic perspective view showing an embodiment of the essential part of the electrophotographic apparatus according to the present invention.

FIG. 1 shows an essential part of the electrophotographic apparatus according to the present invention. Referring to FIG. 1, a charging member 1 having a roller form is disposed so that it contacts an electrophotographic photosensitive member 2, and the charging member 1 may charge the photosensitive member 2 on the basis of the voltage applied thereto from an external power supply 3 connected to the charging member 1.

The form or shape of the charging member 1 may be, in addition to the above-mentioned roller form as shown in FIG. 1, any of blade, belt, etc. The form of the charging member can appropriately be selected corresponding to the specifications and form of an electrophotographic apparatus. The material constituting the charging member 1 includes: metals such as aluminum, iron and copper; electroconductive polymer materials such as polyacetylene, polypyrrole and polythiophene; rubbers or artificial fibers supplied with electroconductivity, e.g., by dispersing therein electroconductive particles such as carbon and metal; and insulating material such as polycarbonate, polyvinyl chloride and polyester having a surface coated with a metal or another conductive material. At least the surface portion of the charging member 1 may preferably comprise an elastic or elastomeric material. The volume resistivity of the charging member 1 may preferably be $10^0-10^{12}$ ohm.cm, particularly $10^2-10^{10}$ ohm.cm. The contact pressure between the charging member and the photosensitive member may be about 100 g/cm or smaller, while it varies depending on the material and/or shape of the charging member.

In order to roughen the surface of the charging member 1, there may be used: one using an abrasive method; one wherein the surface is mechanically ground by a sandblasting method, etc.; one wherein the surface is caused to have an orange peel-like form, e.g., by regulating the condition of drying to be effected after coating; one wherein the surface is exposed to a solvent; etc.

In the present invention, the above-mentioned ten-point mean surface roughness ($Rz_2$) of the charging member may be measured by using a universal surface shape-measuring machine (Model: SE-3C, mfd. by Kosaka Kenkyusho) according to Japanese Industrial Standard (JIS-B-0601).

Figure 2:
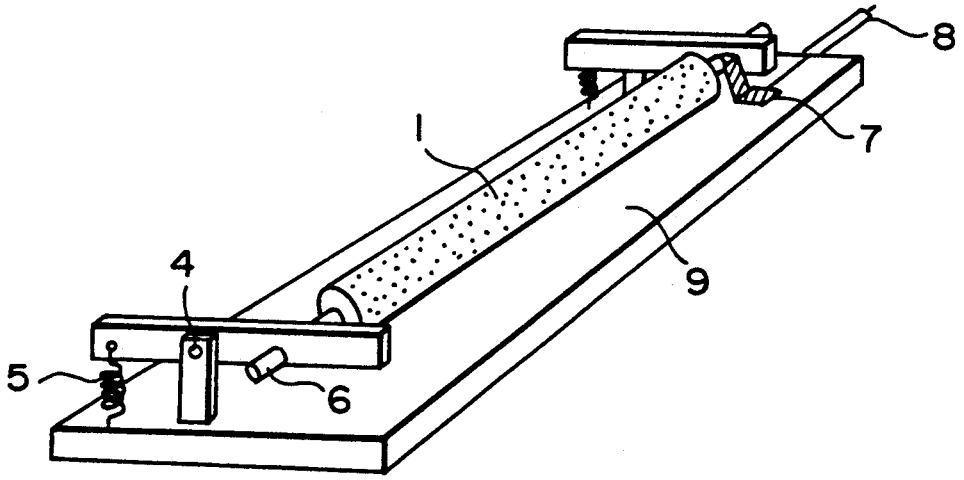
FIG. 2 is a schematic perspective view showing an embodiment of the charging unit for using a charging member.
Figure 3:
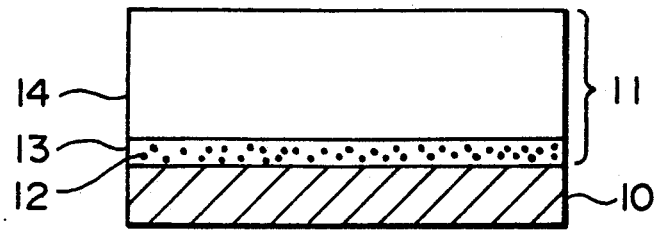
FIGS. 3, 4 and 5 are schematic sectional view each showing an embodiment of the laminar structure of photosensitive layer of the electrophotographic photosensitive member according to the present invention.
Figure 4:
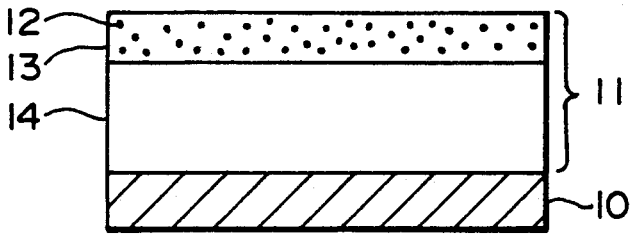
Figure 5:
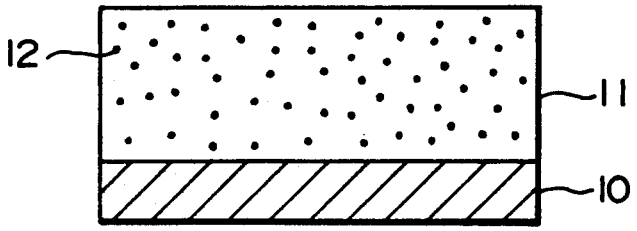

FIG. 2 shows an embodiment of a charging unit for causing a charging member 1 to contact a photosensitive member (not shown) under pressure. Referring to FIG. 2, the charging member 1 in the form of a roller is disposed so that it may contact the photosensitive member under pressure on the basis of the action of a supporting point 4 and a spring 5 which is disposed opposite to the charging member 1 by the medium of the supporting point 4. A core bar 6 is disposed in the central portion of the charging member 1, and supplied with a voltage by means of a feed brush 7 disposed in contact with the core bar 6. In FIG. 2, reference numeral 8 denotes a receiving connector for receiving a voltage from the apparatus body (not shown) and numeral 9 denotes a supporting member for supporting the charging member 1, which is disposed e.g., along a guide rail (not shown) disposed FIGS. 3, 4 and 5 show typical structures of the electrophotographic photosensitive member usable in the present invention, wherein the photosensitive layer comprises an organic photoconductor as a main component. The organic photoconductor may comprise an organic photoconductive polymer such as polyvinylcarbazole, or a binder resin containing therein a low-molecular weight organic photoconductive material.

In the electrophotographic photosensitive member as shown in FIG. 3, a photosensitive layer 11 is disposed on an electroconductive substrate 10. The photosensitive layer 11 comprises a charge generation layer 13 comprising a binder resin and a charge-generating substance 12 dispersed therein, and a charge transport layer 14 comprising a charge-transporting substance (not shown). In this embodiment, the charge transport layer 14 is disposed on the charge generation layer 13.

In the electrophotographic photosensitive member as shown in FIG. 4, unlike that shown in FIG. 3, a charge transport layer 14 is disposed under a charge generation layer 13. In such a case, the charge generation layer 13 can contain a charge-transporting substance, as desired.

In the electrophotographic photosensitive member as shown in FIG. 5, a photosensitive layer 11 is disposed on an electroconductive substrate 10. The photosensitive lay r 11 comprises a binder resin and a charge-generating substance 12 and a charge-transporting substance (not shown) contained therein.

In the present invention, the photosensitive member may preferably have a structure as shown in FIG. 3, which comprises the electroconductive substrate 10, and the charge generation layer 13 and the charge transport layer 14 disposed in this order on the substrate 10.

As the electroconductive substrate 10, there may be used a cylindrical member, a sheet, a film, etc., of a material including metals such as aluminum and stainless steel, papers, plastics, etc. On the above-mentioned cylindrical member, sheet or film, there may be disposed, as desired, a layer of an electroconductive polymer, or a resinous layer containing electroconductive particles such as those of tin oxide, titanium oxide or silver.

Between the electroconductive substrate and the photosensitive layer, there may be formed an undercoat layer (or adhesive layer) having a barrier function and an undercoat function. The undercoat layer may be formed as desired, for various purposes. These purposes may include: improvement in the adhesion or coating characteristic of the photosensitive layer, protection of the substrate, covering for the surface defect of the substrate, improvement in charge injection from the substrate, protection of the photosensitive layer from an electric breakdown, etc. The thickness of the undercoat layer may preferably be about 0.2 to 2 microns.

As the charge-generating substance, there may be used, e.g., pyrilium or thiopyrylium dyes, phthalocyanine-type pigments, anthanthrone pigments; dibenzpyrene-quinone pigment, pyranthrone pigment, azo pigments, indigo pigments, quinacridone type pigments, quinocyanine compounds, asymmetric quinocyanine compounds, etc. On the other hand, as the charge-transporting substance, there may be used, e.g., hydrazone compounds, pyrazoline compounds, stilbene-type compounds, oxazole compounds, thiazole compounds, triarylmethane compounds, polyaryl alkanes, etc.

In order to form the charge generation layer 13, e.g., the above-mentioned charge-generating substance and a binder resin, preferably in an amount of 0.5–4 times that of the charge-generating substance, are sufficiently dissolved or dispersed in a solvent by a dispersing means such as homogenizer, ultrasonic apparatus, ball mill, vibrating ball mill, sand mill, attritor or roll mill, and the resultant coating liquid may be applied onto a substrate, etc., and then dried. The charge generation layer 13 may preferably have a thickness of 5 microns or below, more preferably about 0.01–1 micron.

In order to form the charge transport layer 14, the above-mentioned charge-transporting substance and a binder resin are dissolved or dispersed in a solvent, and the resultant coating liquid may be applied onto the charge generation layer, etc. The mixing ratio of the charge-transporting material to the binder resin may preferably be about 2:1 to 1:2. Further, specific examples of the solvent may include: ketones such as acetone and methyl ethyl ketone; esters such as methyl acetate and ethyl acetate; aromatic hydrocarbons such as toluene and xylene; chlorohydrocarbons such as chlorobenzene, chloroform, and carbon tetrachloride, etc.

In order to apply the above-mentioned coating liquid, there may be used various coating methods such as dip coating, spray coating, spinner coating. The drying may be conducted for a time in the range of 5 minutes to 5 hours preferably 10 minutes to 2 hours, at a temperature of 10° C. to 200° C., preferably 20° C.–150° C., under quienscent condition or under blowing. The thus formed charge transport layer 14 may preferably have a thickness of about 5–30 microns, more preferably about 10–25 microns.

Examples of the binder resin used for the formation of the charge transport layer 14 may include; acrylic resins, styrene resins, polyesters, polycarbonates, polyacrylates, polysulfones, polyphenylene oxide resins, epoxy resins, polyurethane resins, alkyd resins, unsaturated resin, etc. Among these, preferred examples may be: polymethyl methacrylate, polystyrene, styreneacrylonitrile copolymer, polycarbonate resin, or diallyl phthalate resin.

Further, the charge transport layer and/or the charge generation layer used in the present invention may further contain various additives such as antioxidant, ultraviolet ray-absorbing agent and lubricant.

In order to roughen the surface of the electrophotographic photosensitive member according to the present invention, there may be used various methods including: one wherein the surface is mechanically ground by using an abrasive or by sandblasting; one wherein electrically inert particles such as metal oxide powder and resin powder are dispersed in the surface layer of a photosensitive member; etc.

The ten-point mean surface roughness ($Rz_1$) of the photosensitive member may be measured in the same manner as that in the case of the charging member.

A photosensitive layer which is constituted so that its surface predominantly comprises a resin generally provides a smooth surface. When a photosensitive member having such a smooth surface contacts a charging member having a smooth surface, the photosensitive member closely adheres to the charging member, whereby a surface defect of the photosensitive member is liable to occur due to peeling of the photosensitive layer. In the present invention, however, since the photosensitive member and charging member have the above-mentioned specific surface roughnesses, they may retain an appropriate contact state therebetween, whereby the above-mentioned problem does not occur.

Figure 6:
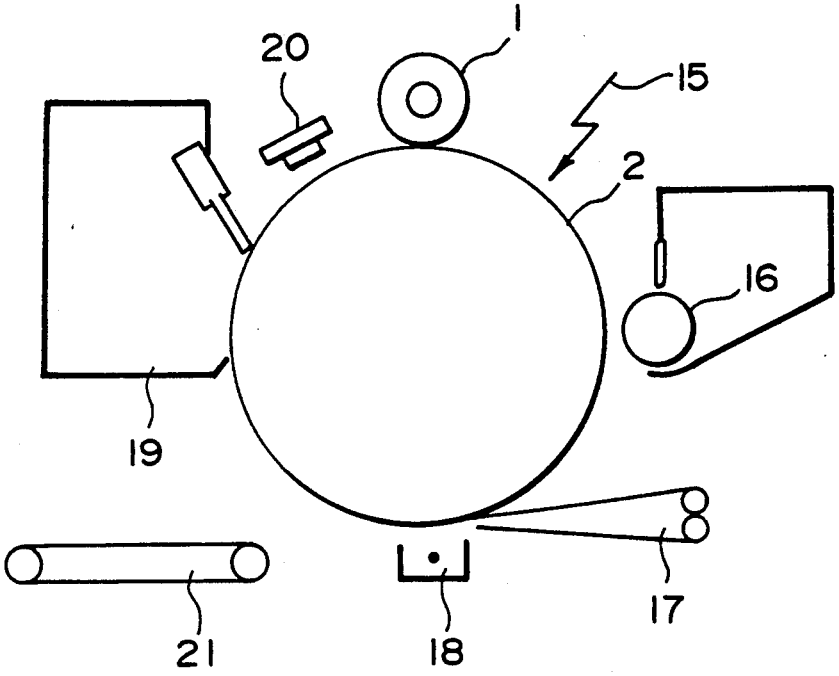
FIG. 6 is a schematic sectional view showing an image forming apparatus including an embodiment of the electrophotographic apparatus according to the present invention.

FIG. 6 shows an embodiment of the image forming apparatus using the electrophotographic apparatus according to the present invention.

Referring to FIG. 6, the image forming apparatus comprises: an electrophotographic photosensitive member 2, and around the peripheral surface of the photosensitive member 2, a charging member 1 in the form of a roller, an image exposure means (not shown) for providing a light beam 15 to form a latent image on the photosensitive member 2, a developing device 16 for developing the latent image with a toner or developer (not shown) to form a toner image on the photosensitive member 2, a transfer charger 18 for transferring the toner image from the photosensitive member 2 onto a transfer material (not shown), a cleaner 19 for removing a residual toner from the photosensitive member 2, and a pre-exposure means 20 for providing light to the photosensitive member 2. The image forming apparatus shown in FIG. 6 further comprises a pair of paper feed rollers and a paper feed guide 17 for supplying the transfer material (or transfer-receiving material) such as paper to the photosensitive member 2.

In operation, a voltage is applied to the charging member 1 disposed in contact with the photosensitive member 2, thereby to charge the surface of the photosensitive member 2, and the photosensitive member 2 is imagewise exposed to light 15 corresponding to an original image by the image exposure means, thereby to form an electrostatic latent image on the photosensitive member 2. Then, the electrostatic latent image formed on the photosensitive member 2 is developed or visualized by attaching the toner or developer contained in the developing device 16 to form a toner image on the photosensitive member 2. The toner image is then transferred to the transfer material such as paper which has been supplied by means of the paper feed rollers and paper feed guide 17, by means of the transfer charger 18 to form a toner image on the transfer material. The residual toner which remains on the photosensitive member 2 without transferring to the transfer material at the time of transfer is recovered by means of the cleaner 19.

Thus, the copied image is formed by such an electrophotographic process. In a case where residual charge remains on the photosensitive member 2, the photosensitive member 2 may preferably be exposed to light by the pre-exposure means 20 to remove the residual charge, prior to the above-mentioned primary charging based on the charging member 1. On the other hand, the transfer material on which the above-mentioned toner image has been formed may be conveyed to a fixing unit (not shown) by means of a conveyor 21, whereby the toner image is fixed to the transfer material.

The light source for providing light 15 for image exposure may be a halogen lamp, a fluorescent lamp, a laser, etc. Further, another auxiliary process may be included in the above-mentioned electrophotographic process, as desired.

In the present invention, the voltage applied to the charging member 1 may be a DC voltage alone, but may preferably be a superposition of a DC voltage and an AC voltage in order to stably effect uniform charging. The DC voltage may appropriately be determined depending on an intended surface potential of the photosensitive member, but may preferably be ±400 V to ±1,000 V, more preferably ±550 V to ±850 V. The AC voltage to be superposed on the DC voltage may preferably be 1,800 V or lower, more preferably 1,500 V or lower, in terms of peak-to-peak value (Vpp) of the alternating current voltage.

The method for applying a voltage, while also varying depending on the specifications of respective electrophotographic apparatus, may include: one wherein a desired voltage is instantaneously applied; one wherein the applied voltage is gradually or stepwise raised in order to protect a photosensitive member; or one wherein a DC voltage and an AC voltage are applied in a sequence of from DC voltage to AC voltage, or of from AC voltage to DC voltage.

The electrophotographic apparatus according to the present invention may be used not only for ordinary copying machines but also in the fields related to electrophotography such as laser-beam printers, CRT printers and electrophotographic plate-making.

Hereinbelow, the present invention will be explained more specifically with reference to examples.

EXAMPLE 1

100 wt. parts of urethane rubber (Coronate, mfd. by Nihon Polyurethane Kogyo K.K., JIS-A, hardness = 30 degrees) and 4 wt. parts of electroconductive carbon (Conductex 900, mfd. by Columbian Carbon Co.) were melt-kneaded at 50° C. for 1 hour by using rollers, and the resultant mixture was shaped into a roller form having a diameter of 20 mm and a length of 330 mm, wherein a core bar of stainless steel having a diameter of 5 mm and a length of 350 mm had been disposed as a center shaft, thereby to prepare a charging member having a volume resistivity of $10^6$ ohm.cm.

The thus prepared nine charging members were mechanically ground by using a lapping tape so that they provided ten-point mean surface roughnesses ($Rz_1$) of 0 micron, 0.05 micron, 0.1 micron, 0.3 micron, 1.0 micron, 3.0 microns, 4.0 microns, 5.0 microns and 6.0 microns, respectively.

Separately, an electrophotographic photosensitive member was prepared in the following manner.

A 5% solution of a polyamide resin (trade name: Amilan CM-8000, mfd. by Toray K.K.) in methanol was applied on a substrate of an aluminum cylinder having a diameter of 80 mm and a length of 360 mm by dip coating and then dried thereby to form a 1 micron-thick undercoat layer on the aluminum substrate.

Next, 10 parts (parts by weight, the same also in the description appearing hereinafter) of a bisazo pigment represented by the following structural formula, and 8 parts of a polyvinyl butyral resin (S-LEC BXL, mfd. by Sekisui Kagaku K.K.) were dispersed in 60 parts of cyclohexanone by means of a sand mill using 1 mm-diameter glass beads, for 20 hours.

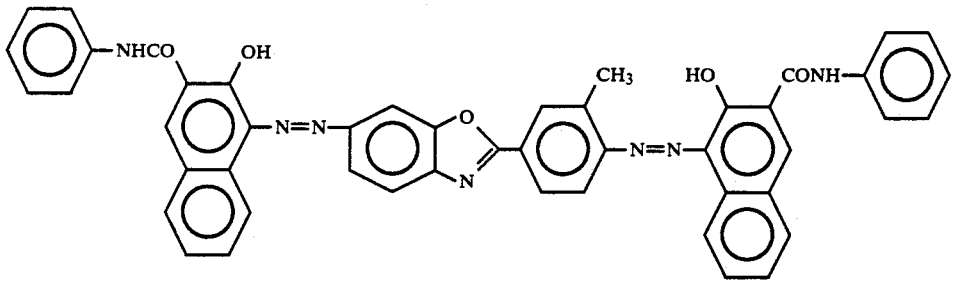

To the resultant dispersion, 100 parts of methyl ethyl ketone was added, and then the dispersion was applied onto the undercoat layer thereby to form thereon a 0.12 micron-thick charge generation layer.

Separately, 7 parts of a hydrazone compound represented by the following structural formula and 10 parts of a polystyrene resin (trade name: Diarex HF-55, mfd. by Mitsubishi Monsanto Kasei K.K.), as a binder resin were dissolved in 50 parts of monochlorobenzene.

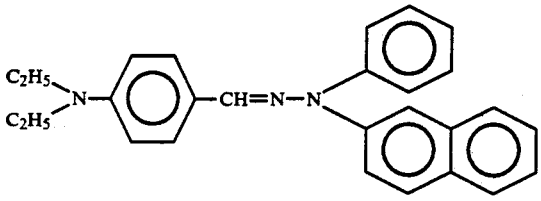

The resultant solution was applied onto the above-mentioned charge generation layer and dried to form a 19 microns-thick charge transport layer, whereby a photosensitive member was obtained.

The thus prepared seven charging members were mechanically ground so that they provided ten-point mean surface roughnesses ($Rz_2$) of 0 micron, 0.05 micron, 0.1 micron, 0.3 micron, 1.0 micron, 3.0 microns and 5.0 microns, respectively.

Each of the above-mentioned charging members was assembled in a charging unit as shown in FIG. 2 (spring constant of the spring 5 = 0.1 kg/mm) and the resultant charging unit was assembled in an image forming apparatus as shown in FIG. 6 equipped with each of the above-mentioned photosensitive members. By using the resultant image forming apparatus, a successive copying test of 10,000 sheets (A-4 size) was conducted in an environment of 23° C., 50% RH by using an original having an image portion of 6%.

The image forming apparatus used herein comprised a modification of a copying machine (trade name: NP 3525, mfd. by Canon K.K.) wherein the image exposure means, developing device, paper feed system, transfer charger, conveyor system, and pre-exposure means were used as such. This modification used the above-mentioned charging member 1 in the form of a roller as the charging means, and had been modified so that it conducted cleaning by blade cleaning alone by using a cleaner comprising a silicone rubber blade. The voltage applied to the charging unit was a superposition of a DC voltage of −700 V and an AC voltage having a peak-to-peak voltage (Vpp) of 1,500 V and a frequency of 1,000 Hz.

The results were evaluated by measuring the surface potential of the photosensitive member in the initial stage when it was charged by using the charging member, and the image densities of the copied images obtained before and after the successive copying of 10,000 sheets. The surface potential was measured by means of a surface potential meter (trade name: 244 Surface Potential Meter, mfd. by Monroe Electronics Inc.). The copied image was evaluated by measuring the reflection density of the solid black image portion by means of a Macbeth Reflection Densitometer (mfd. by Macbeth Co.).

The results are shown in the following Table 1. In Table 1, the symbol "" denotes a reflection density of 1.3 or higher, symbol "" denotes a reflection density of not lower than 1.0 and lower than 1.3, symbol "Δ" denotes a reflection density of not lower than 0.8 and lower than 1.0, symbol "x" denotes a reflection density of not lower than 0.5 and lower than 0.8, and symbol "xx" denotes a reflection density of lower than 0.5.

TABLE 1

| $Rz_1 + Rz_2$ (μm) | $Rz_1$ (μm) | $Rz_2$ (μm) | Initial surface potential (−V) | Evaluation of image: Before successive copying | Evaluation of image: After successive copying |
|---|---|---|---|---|---|
| 0.05 | 0 | 0.05 | 610 | Δ | x |
| 0.1 | 0.05 | 0.05 | 690 | ○ | Δ |
| 0.4 | 0.1 | 0.3 | 700 | ○ | ○ |
| 1.3 | 0.3 | 1.0 | 700 | ⊙ | ○ |
| 2.0 | 1.0 | 1.0 | 700 | ⊙ | ⊙ |
| 4.0 | 1.0 | 3.0 | 700 | ⊙ | ⊙ |
| 5.3 | 0.3 | 5.0 | 700 | ⊙ | ○ |
| 6.0 | 1.0 | 5.0 | 690 | ○ | Δ |
| 6.0 | 3.0 | 3.0 | 680 | ○ | Δ |
| 7.0 | 1.0 | 6.0 | 620 | Δ | x |
| 9.0 | 3.0 | 6.0 | 550 | x | xx |
| 11.0 | 5.0 | 6.0 | 490 | x | xx |

As described above, it was found that charging evenness was retained, the initial surface potential was not substantially lowered, and good images without white spots were obtained, when the following conditions were satisfied:

$0.1 \text{ micron} \leqq Rz_1 + Rz_2 \leqq 6.0 \text{ microns}$,
$0.05 \text{ micron} \leqq Rz_1 \leqq 5.0 \text{ microns}$, and
$0.05 \text{ micron} \leqq Rz_2 \leqq 5.0 \text{ microns}$.

On the other hand, it was found that when the sum of $Rz_1$ and $Rz_2$ was outside the above-mentioned range, the charging became uneven and stable charging was not effected, whereby an image defect occurred.

EXAMPLE 2

Figure 7:
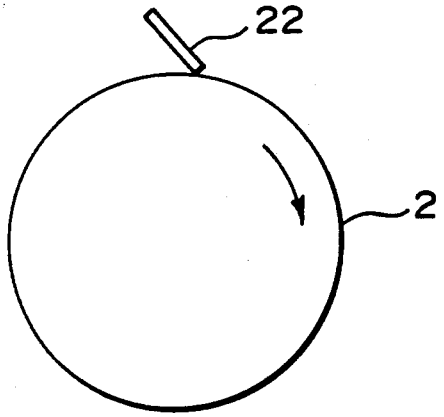
FIG. 7 is a schematic sectional view showing a positional relationship between the charging member and photosensitive member used in Example 2 appearing hereinafter.

A plate-type blade 22 as shown in FIG. 7 having a volume resistivity of $10^8$ ohm.cm, a thickness of 2 mm, a height of 20 mm and a width of 330 mm was shaped by using the above-mentioned material used for shaping the roller charging member obtained in Example 1.

The resultant blade 22 was assembled in the image forming apparatus in the same manner as in Example 1 except that the blade 22 was caused to contact the photosensitive member 2 so that it was disposed in the forward direction with respect to the moving direction of the photosensitive member 2 as shown in FIG. 7. By using the thus assembled image forming apparatus, evaluation was conducted in the same manner as in Example 1.

The results are shown in the following Table 2.

TABLE 2

| $Rz_1 + Rz_2$ (μm) | $Rz_1$ (μm) | $Rz_2$ (μm) | Initial surface potential (−V) | Evaluation of image: Before successive copying | Evaluation of image: After successive copying |
|---|---|---|---|---|---|
| 0.05 | 0 | 0.05 | 580 | x | x |
| 0.1 | 0.05 | 0.05 | 670 | Δ | Δ |
| 0.4 | 0.1 | 0.3 | 690 | ○ | Δ |
| 1.3 | 0.3 | 1.0 | 700 | ⊙ | ○ |
| 2.0 | 1.0 | 1.0 | 700 | ⊙ | ⊙ |
| 4.0 | 1.0 | 3.0 | 700 | ⊙ | ⊙ |
| 5.3 | 0.3 | 5.0 | 700 | ⊙ | ○ |
| 6.0 | 1.0 | 5.0 | 680 | ○ | Δ |
| 6.0 | 3.0 | 3.0 | 670 | ○ | Δ |
| 7.0 | 1.0 | 6.0 | 600 | x | x |
| 9.0 | 3.0 | 6.0 | 550 | x | xx |
| 11.0 | 5.0 | 6.0 | 490 | x | xx |

As described above, it was found that good images were obtained similarly as in Example 1, when the ten-point mean surface roughness ($Rz_1$) of the photosensitive member and the ten-point mean surface roughness ($Rz_2$) of the charging member were retained so that they satisfied the above-mentioned conditions according to the present invention.

EXAMPLE 3

A photosensitive member was prepared in the same manner as in Example 1 except that a styrenemethyl methacrylate copolymer (trade name: Estyrene MS-300, mfd. by Shin-Nichitetsu Kagaku K.K.) was used as the binder resin of the charge transport layer instead of the polystyrene resin used in Example 1.

The thus obtained photosensitive member was assembled in the image forming apparatus used in Example 1 together with the charging unit used in Example 1 and the resultant apparatus was used for evaluation of images in the same manner as in Example 1.

The results were shown in the following Table 3.

TABLE 3

| $Rz_1 + Rz_2$ (μm) | $Rz_1$ (μm) | $Rz_2$ (μm) | Initial surface potential (−V) | Evaluation of image: Before successive copying | Evaluation of image: After successive copying |
|---|---|---|---|---|---|
| 0.05 | 0 | 0.05 | 600 | Δ | x |
| 0.1 | 0.05 | 0.05 | 690 | ○ | Δ |
| 0.4 | 0.1 | 0.3 | 700 | ○ | ○ |
| 1.3 | 0.3 | 1.0 | 700 | ⊙ | ○ |
| 2.0 | 1.0 | 1.0 | 700 | ⊙ | ⊙ |
| 4.0 | 1.0 | 3.0 | 700 | ○ | ⊙ |

TABLE 3-continued

| $Rz_1 + Rz_2$ (μm) | $Rz_1$ (μm) | $Rz_2$ (μm) | Initial surface potential (−V) | Evaluation of image: Before successive copying | Evaluation of image: After successive copying |
|---|---|---|---|---|---|
| 5.3 | 0.3 | 5.0 | 700 | ⊙ | ○ |
| 6.0 | 1.0 | 5.0 | 690 | ○ | Δ |
| 6.0 | 3.0 | 3.0 | 670 | ○ | Δ |
| 7.0 | 1.0 | 6.0 | 620 | Δ | x |
| 9.0 | 3.0 | 6.0 | 560 | x | xx |
| 11.0 | 5.0 | 6.0 | 510 | x | xx |

As described above, it was found that good images were obtained similarly as in Examples 1 and 2, when the ten-point mean surface roughness ($Rz_1$) of the photosensitive member and the ten-point mean surface roughness ($Rz_2$) of the charging member were retained so that they satisfied the above-mentioned conditions according to the present invention.

EXAMPLE 4

In the image forming apparatus used in Example 1, AC voltage (Vpp) to be superposed on the DC voltage was changed as shown in the following Table 4, while the ten-point mean surface roughnesses of the photosensitive member and charging member were combined as shown in the following Table 4. Thus, the initial surface potential of the photosensitive member, copied images obtained before and after successive copying of 10,000 sheets, and the number of dielectric breakdowns of the photosensitive member were observed or measured in an environment of 23° C., 50% RH. The DC voltage applied to the charging member was −700 V.

The number of the dielectric breakdowns was the number of the white dropouts having a diameter of 1 mm or larger and white dropouts (or white streaks) having a width of 1 mm or larger and extending along a direction parallel to the longitudinal direction of the photosensitive member, which occurred in the solid black images portions.

The results are shown in the following Table 4.

TABLE 4

| AC voltage (V) (Vpp) | $Rz_1 + Rz_2$ (μm) | $Rz_1$ (μm) | $Rz_2$ (μm) | Initial surface potential (−V) | Evaluation of image: Before successive copying | Evaluation of image: After successive copying | Number of dielectric breakdowns of photosensitive member |
|---|---|---|---|---|---|---|---|
| 1000 | 0.05 | 0 | 0.05 | 420 | x | xx | 0 |
| (f = 1000 Hz) | 0.1 | 0.05 | 0.05 | 670 | ○ | Δ | 0 |
| | 0.4 | 0.1 | 0.3 | 700 | ○ | Δ | 0 |
| | 1.3 | 0.3 | 1.0 | 700 | ⊙ | ○ | 0 |
| | 2.0 | 1.0 | 1.0 | 700 | ⊙ | ⊙ | 0 |
| | 4.0 | 1.0 | 3.0 | 700 | ⊙ | ⊙ | 0 |
| | 5.3 | 0.3 | 5.0 | 650 | ○ | Δ | 0 |
| | 7.0 | 1.0 | 6.0 | 410 | x | xx | 0 |
| 1500 | 0.05 | 0 | 0.05 | 610 | Δ | x | 0 |
| (f = 1000 Hz) | 0.1 | 0.05 | 0.05 | 690 | ○ | Δ | 0 |
| | 0.4 | 0.1 | 0.3 | 700 | ○ | ○ | 0 |
| | 1.3 | 0.3 | 1.0 | 700 | ⊙ | ○ | 0 |
| | 2.0 | 1.0 | 1.0 | 700 | ⊙ | ⊙ | 0 |
| | 4.0 | 1.0 | 3.0 | 700 | ⊙ | ⊙ | 0 |
| | 5.3 | 0.3 | 5.0 | 700 | ⊙ | ○ | 0 |
| | 7.0 | 1.0 | 6.0 | 620 | Δ | x | 0 |
| 1800 | 0.05 | 0 | 0.05 | 700 | Δ | Δ | 7 |
| (f = 1000 Hz) | 0.1 | 0.05 | 0.05 | 700 | ○ | ○ | 1 |
| | 0.4 | 0.1 | 0.3 | 700 | ○ | ○ | 0 |
| | 1.3 | 0.3 | 1.0 | 700 | ⊙ | ○ | 0 |
| | 2.0 | 1.0 | 1.0 | 700 | ⊙ | ⊙ | 0 |
| | 4.0 | 1.0 | 3.0 | 700 | ⊙ | ⊙ | 0 |
| | 5.3 | 0.3 | 5.0 | 700 | ⊙ | ○ | 1 |
| | 7.0 | 1.0 | 6.0 | 700 | Δ | Δ | 6 |

*f: frequency of the AC voltage

As described above, it was found that the combinations of charging member and photosensitive member providing ($Rz_1+Rz_2$) of 0.05 micron and 7.0 microns could provide no white spots, when the AC voltage to be superposed on the DC voltage was raised. This may be because the charging was uniformized. However, in such a case, since the maximum application voltage of the AC voltage was increased, the photosensitive member caused dielectric breakdown, whereby a good copied image was not obtained.

On the other hand, the combinations of the photosensitive member and charging member providing ($Rz_1+Rz_2$) of 0.1 micron, 0.4 micron, 1.3 micron, 2.0 microns, 4.0 microns and 5.3 microns satisfying the conditions according to the present invention caused substantially no dielectric breakdown and provided good copied images.

What is claimed is:

1. An electrophotographic apparatus comprising a photosensitive member and a charging member disposed in contact with the photosensitive member; said photosensitive member being capable of being charged by applying a voltage to the charging member;

wherein the ten-point mean surface roughness ($Rz_1$) of the photosensitive member and the ten-point mean surface roughness ($Rz_2$) of the charging member satisfy the following relationships:

$$0.1 \text{ micron} \leqq Rz_1 + Rz_2 \leqq 6.0 \text{ microns},$$
$$0.05 \text{ micron} \leqq Rz_1 \leqq 5.0 \text{ microns, and}$$

-continued

| |
|---|
| 0.05 micron $\leqq Rz_2 \leqq 5.0$ microns. |

2. An apparatus according to claim 1, wherein $Rz_1$ and $Rz_2$ satisfy a relationship of 1.3 micron $\leqq Rz_1+Rz_2 \leqq 5.3$ microns.

3. An apparatus according to claim 1, wherein $Rz_1$ and $Rz_2$ satisfy a relationship of 2.0 micron $\leqq Rz_1+Rz_2 \leqq 4.0$ microns.

4. An apparatus according to any of claims 1 to 3, wherein $Rz_1$ is not smaller than 0.1 micron and not larger than 3 microns.

5. An apparatus according to any of claims 1 to 3, wherein the charging member has a shape selected from the group consisting of a roller, a blade and a belt.

6. An apparatus according to any of claims 1 to 3, wherein the charging member comprises a rubber and electroconductive particles dispersed therein.

7. An apparatus according to any of claims 1 to 3, wherein the photosensitive member comprises a photosensitive layer comprising an organic photoconductor as a main component.

8. An apparatus according to claim 7, wherein the photosensitive layer comprises a laminate of a charge generation layer and a charge transport layer.

9. An apparatus according to any of claims 1 to 3, wherein the voltage comprises a superposition of a DC voltage and an AC voltage.

10. An apparatus according to claim 9, wherein the AC voltage to be superposed on the DC voltage has a peak-to-peak value (Vpp) of 1,800 V or lower.

11. An apparatus according to claim 10, wherein the AC voltage to be superposed on the DC voltage has a peak-to-peak value (Vpp) of 1,500 V or lower.

* * * * *

UNITED STATES PATENT AND TRADEMARK OFFICE

CERTIFICATE OF CORRECTION

PATENT NO. : 5,008,706

DATED : April 16, 1991

INVENTOR(S) : HIROYUKI OHMORI, ET AL.

It is certified that error appears in the above-identified patent and that said Letters Patent is hereby corrected as shown below:

COLUMN 1

Line 44, "occur" should read --occurs--.

COLUMN 2

Line 37, "has" should read --have--.

COLUMN 3

Line 27, "out" should read --our--.
Line 51, "micron" should read --microns--. (2nd occurrence)

COLUMN 4

Line 9, "view" should read --views--.
Line 27, "surface" should read --mean surface--.
Line 39, "break down" should read --breakdown--.
Line 46, "micron" should read --microns--.

COLUMN 5

Line 51, "disposed" should read --disposed on the apparatus body side.--.

COLUMN 6

Line 9, "lay r" should read --layer--.

UNITED STATES PATENT AND TRADEMARK OFFICE

CERTIFICATE OF CORRECTION

PATENT NO. : 5,008,706

DATED : April 16, 1991

INVENTOR(S) : HIROYUKI OHMORI, ET AL.

It is certified that error appears in the above-identified patent and that said Letters Patent is hereby corrected as shown below:

COLUMN 7

Line 10, "quienscent" should read --quiescent--.
Line 15, "include;" should read --include:--.
Line 34, "member;" should read --member,--.

COLUMN 10

Line 62, "symbol """ should read --symbol "◎"--.
Line 63, "symbol """ should read --symbol "○"--.

COLUMN 12

TABLE 2, "After successive copying should read --After successive copying

| "After successive copying | --After successive copying |
|---|---|
| × | ×× |
| △ | △ |
| △ | △ |
| ○ | ○ |
| ◎ | ◎ |
| ◎ | ◎ |
| ○ | ○ |
| △ | △ |
| △ | △ |
| × | × |
| ×× | ×× |
| ×× " | ×× --. |

UNITED STATES PATENT AND TRADEMARK OFFICE

CERTIFICATE OF CORRECTION

PATENT NO. : 5,008,706

DATED : April 16, 1991

INVENTOR(S) : HIROYUKI OHMORI, ET AL.

It is certified that error appears in the above-identified patent and that said Letters Patent is hereby corrected as shown below:

COLUMN 12

TABLE 3, "Before successive copying should read --Before successive copying

| | |
|---|---|
| △ | △ |
| ○ | ○ |
| ○ | ○ |
| ◎ | ◎ |
| ◎ | ◎ |
| ○ | ◎ |

" --.

COLUMN 13

Line 38, "images" should read --image--

COLUMN 14

Line 21, "micron," should read --microns,--. (3rd occurrence)

UNITED STATES PATENT AND TRADEMARK OFFICE

CERTIFICATE OF CORRECTION

PATENT NO. : 5,008,706

DATED : April 16, 1991

INVENTOR(S) : HIROYUKI OHMORI, ET AL.

It is certified that error appears in the above-identified patent and that said Letters Patent is hereby corrected as shown below:

COLUMN 15

Line 9, "cron" should read --crons--.
Line 12, "cron" should read --crons--.

Signed and Sealed this

First Day of December, 1992

*Attest:*

*Attesting Officer*

DOUGLAS B. COMER

*Acting Commissioner of Patents and Trademarks*